US009580260B2

(12) United States Patent
Cheng et al.

(10) Patent No.: US 9,580,260 B2
(45) Date of Patent: Feb. 28, 2017

(54) SHEET-FEEDING DEVICE WITH MULTISTAGE STOP ARMS

(71) Applicant: Avision Inc., Hsinchu (TW)

(72) Inventors: Sung-Po Cheng, Hsinchu (TW); Kai-Fan Hsueh, Hsinchu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 14/963,848

(22) Filed: Dec. 9, 2015

(65) Prior Publication Data

US 2016/0167902 A1 Jun. 16, 2016

(30) Foreign Application Priority Data

Dec. 15, 2014 (TW) ..... 103143732 A

(51) Int. Cl.
*B65H 3/52* (2006.01)
*B65H 3/34* (2006.01)
(Continued)

(52) U.S. Cl.
CPC ..... *B65H 3/5207* (2013.01); *B65H 3/063* (2013.01); *B65H 3/34* (2013.01); *B65H 3/46* (2013.01); *B65H 3/523* (2013.01); *B65H 3/56* (2013.01); *B65H 2404/50* (2013.01); *B65H 2404/60* (2013.01); *B65H 2404/6942* (2013.01); *B65H 2404/70* (2013.01); *B65H 2404/722* (2013.01);
(Continued)

(58) Field of Classification Search
CPC . B65H 3/06; B65H 3/063; B65H 3/34; B65H 3/36; B65H 3/46; B65H 3/52; B65H 3/5207; B65H 3/5215; B65H 3/523; B65H 3/54; B65H 3/56; B65H 3/66; B65H 9/004; B65H 9/006; B65H 9/06; B65H 2301/331; B65H 2301/44514; B65H 2404/50; B65H 2404/60; B65H 2404/61; B65H 2404/63; B65H 2404/633; B65H 2404/65; B65H 2404/651; B65H 2404/653; B65H 2404/654; B65H 2404/70; B65H 2404/722; B65H 2404/74; B65H 2404/741; B65H 2404/7414
See application file for complete search history.

(56) References Cited

U.S. PATENT DOCUMENTS 5,707,057 A * 1/1998 Oyama ..... B65H 3/54 271/121
5,718,424 A * 2/1998 Nakatani ..... B65H 3/5238 271/121
(Continued)

FOREIGN PATENT DOCUMENTS

EP 0900758 A2 8/1998
TW M477455 U 5/2014

*Primary Examiner* — Prasad Gokhale

(57) ABSTRACT

A feeding device is disclosed, which comprises a paper passage, a sheet-separating roller, a friction institution, and a stopper. The sheet-separating roller is disposed in the paper passage. The friction institution is disposed in the paper passage opposite to the sheet-separating roller. The stopper is disposed in the upstream side of the sheet-separating roller. The stopper includes an axle, a short arm, and a long arm. The short arm connects to the axle, and the axle acts as a fulcrum. The long arm and the short arm disposed to the axle coaxially. A threshold of the force for pushing the short arm is larger than a threshold of the force for pushing the long arm.

17 Claims, 6 Drawing Sheets

(51) Int. Cl.
*B65H 3/06* (2006.01)
*B65H 3/46* (2006.01)
*B65H 3/56* (2006.01)

(52) U.S. Cl.
CPC ..... *B65H 2801/06* (2013.01); *B65H 2801/39* (2013.01)

(56) References Cited

U.S. PATENT DOCUMENTS

| | | | | |
|---|---|---|---|---|
| 6,010,126 | A * | 1/2000 | Mou | B65H 3/063 271/121 |
| 6,017,031 | A * | 1/2000 | Oosawa | B65H 3/56 271/10.09 |
| 6,382,621 | B1 * | 5/2002 | Inoue | B65H 3/0661 271/120 |
| 2011/0123307 | A1 * | 5/2011 | Pillard | B65H 3/063 414/795.4 |
| 2012/0090955 | A1 * | 4/2012 | Jost | B65H 3/063 198/470.1 |
| 2014/0203494 | A1 * | 7/2014 | Okumura | B65H 3/063 271/18 |
| 2014/0374984 | A1 * | 12/2014 | Morimoto | B65H 1/26 271/117 |

* cited by examiner

SHEET-FEEDING DEVICE WITH MULTISTAGE STOP ARMS

The current application claims a foreign priority to application number 103143732 filed on Dec. 15, 2014 in Taiwan.

BACKGROUND OF THE INVENTION

Field of the Invention

The present invention relates to a feeding device, and more particularly, the present invention relates to a feeding device with multistage stop arms.

Description of Related Art

Conventional multi-function machines, such as a scanner, a copier, or other office machine with multi-functions, have an automatic feeding device (or named as automatic document feeder, ADF) for a user to add plural sheets without manual operation. FIG. 6 is a cross-sectional view of conventional feeding device. Referring to FIG. 6, a stack of plural sheets S are placed by a user, and then a sheet-separating roller A would be drive to rotate by the feeding device. The sheet-separating roller A and the friction roller B are acted jointly, and the plural sheets S are separated to feed into the downstream of the paper passage individually. Besides, in the automatic feeding device, the stopper C coordinated with the sheet-transporting roller D is usually applied to position the sheets for a user with convenience. As a result, when the feeding device practices the pick-up work, the situation of miss feed and skew resulted from sheet non-position will not be occurred.

However, in addition to the positioning function, the stopper needs to guide sheets in sequence preferably to ensure feeding smoothly, wherein the sheets are constituted a structure of wedge-shaped inclined plane for reducing the feeding error-ratio. The partial sheets located in lower layer of wedge-shaped inclined plane are close to the sheet-separating roller, and the partial sheets located in upper layer of wedge-shaped inclined plane are far from the sheet-separating roller. The above design can make the sheet-separating roller pick up the bottom sheets firstly. Otherwise, if the stack of the sheets can't be constituted the structure of wedge-shaped inclined plane, the sheet-separating roller would pick up the top sheets, and pick up the bottom sheets by friction simultaneously. This results in a feeding failure of the feeding device, such as multiple feeding, jamming, and sheet breakage. Therefore, making the stack of the sheets being the structure of wedge-shaped inclined plane by the stopper is important. But the difficulty is that: if the elastic force of the stopper is too light, the effect for guiding sheets in sequence can't be reached; if the elastic force of the stopper is too heavy, the thin sheet would not drive the stopper, and results in jamming. Therefore, how to design the elastic force of the stopper is an important issue.

SUMMARY OF THE INVENTION

Accordingly, an object of the present invention is to provide a feeding device with multistage stop arms. The present invention applies multistage stop arms with multi-elasticity to cause the sheets located in upper layer transport slowly. The present invention also causes the sheets located in lower layer transport quickly opposite to the sheets located in upper layer. This is because the short arm of the multistage stop arms has the property of heavy elasticity and large resistance which causes the sheets located in upper layer transport slowly. In the other hand, the long arm of the multistage stop arms has the property of light elasticity and small resistance which causes the sheets located in lower layer transport quickly opposite to the sheets located in upper layer. Due to the design of the short arm and the long arm of the multistage stop arms, a stack of sheets can be constituted a structure of wedge-shaped inclined plane. The long arm with light elasticity causes the thin sheets pass smoothly, and the short arm with heavy elasticity causes the normal sheets or heavy sheets to constitute the structure of wedge-shaped inclined plane.

To achieve the foregoing and other objects, a feeding device is provided. The feeding device comprises a paper passage, a sheet-separating roller, a friction institution, and a stopper. The sheet-separating roller is disposed in the paper passage. The friction institution is disposed in paper passage opposite to the sheet-separating roller. The stopper is disposed in the upstream side of the sheet-separating roller. The stopper includes an axle, a short arm, and a long arm. The short arm is connected to the axle which being a fulcrum. The long arm is disposed in the axle with the short arm coaxially. Wherein, a threshold of the force for pushing the short arm is larger than a threshold of the force for pushing the long arm.

BRIEF DESCRIPTION OF THE DRAWINGS

Other features and advantages of the present invention will become apparent in the following detailed description of the preferred embodiments with reference to the accompanying drawings, of which.

DESCRIPTION OF EMBODIMENTS

Figure 1:
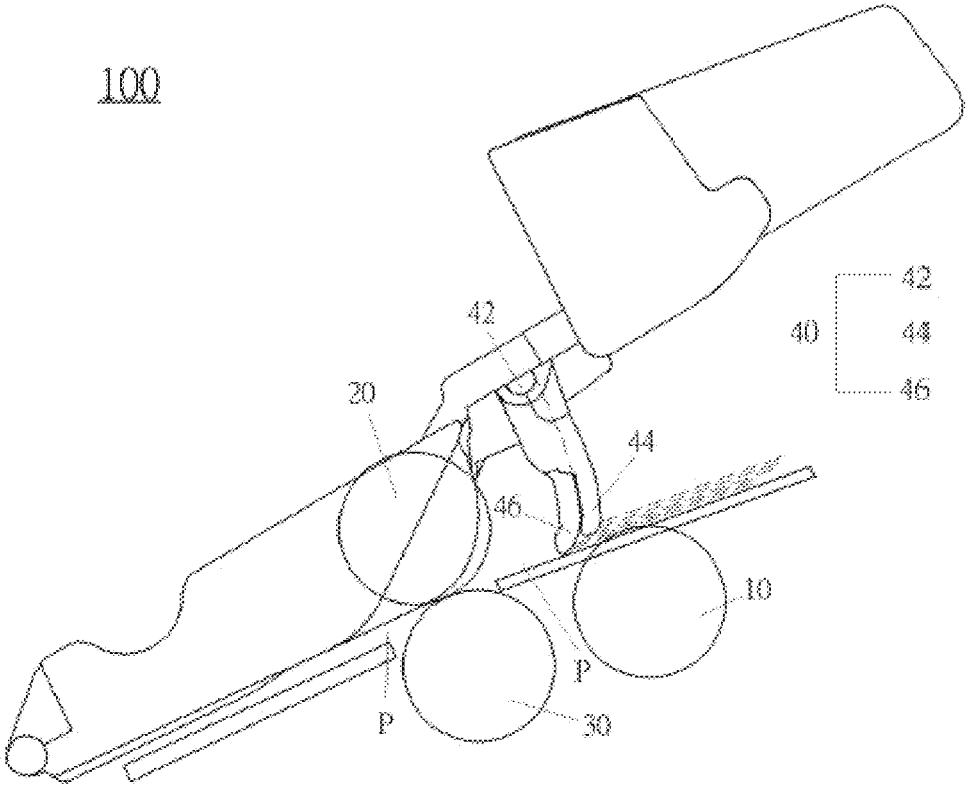
FIG. 1 is a schematic view illustrating a feeding device according to one embodiment of the present invention.

FIG. 1 is a schematic view illustrating a feeding device according to one embodiment of the present invention. Referring to FIG. 1, the feeding device 100 comprises a paper passage P, a sheet-transporting roller 10, a sheet-separating roller 20, a friction institution 30, and a stopper 40. The sheet-separating roller 20 and the friction institution 30 are disposed in the paper passage P, and the disposition of the friction institution 30 is opposite to the sheet-separating roller 20. The sheet-transporting roller 10 is disposed in the paper passage P, and is located in the upstream side of sheet-separating roller 20. The relative relationship between the upstream and the downstream is defined by the feeding direction. This is, the location where the sheets S pass firstly is defined as the upstream, and the location where the sheets S pass lately is defined as the downstream. Wherein, the sheet-separating roller 20 and the sheet-transporting roller 10 constitute a roller assembly. In other word, the roller assembly includes the sheet-separating roller 20 and the sheet-transporting roller 10, and is disposed in the paper passage P. In FIG. 1, the friction institution 30 is, for example, the friction roller, including but not limited to a friction pad or other equivalent elements. The stopper 40 is disposed in the upstream side of the sheet-separating roller 20. The stopper 40 includes an axle 42, a short arm 44, and a long arm 46. The short arm 44 and long arm 46 are coaxially connected with the axle 42 which being a fulcrum. When the sheets S are not placed, the long arm 46 is close to the short arm 44, and the long arm 46 is located in back of the short arm 44. The difference between the short arm 44 and the long arm 46 is: a threshold of the force for pushing the short arm 44 is larger than a threshold of the force for pushing the long arm 46. Further, the short arm 44 includes a heavy spring Q1 with a first elastic force, and the long arm 46 includes a light spring Q2 with a second elastic force, wherein the first elastic force is larger than second elastic force. Therefore, it needs larger force to push the short arm 44. Opposite the short arm 44, it needs light force to push the long arm 46.

Figure 2:
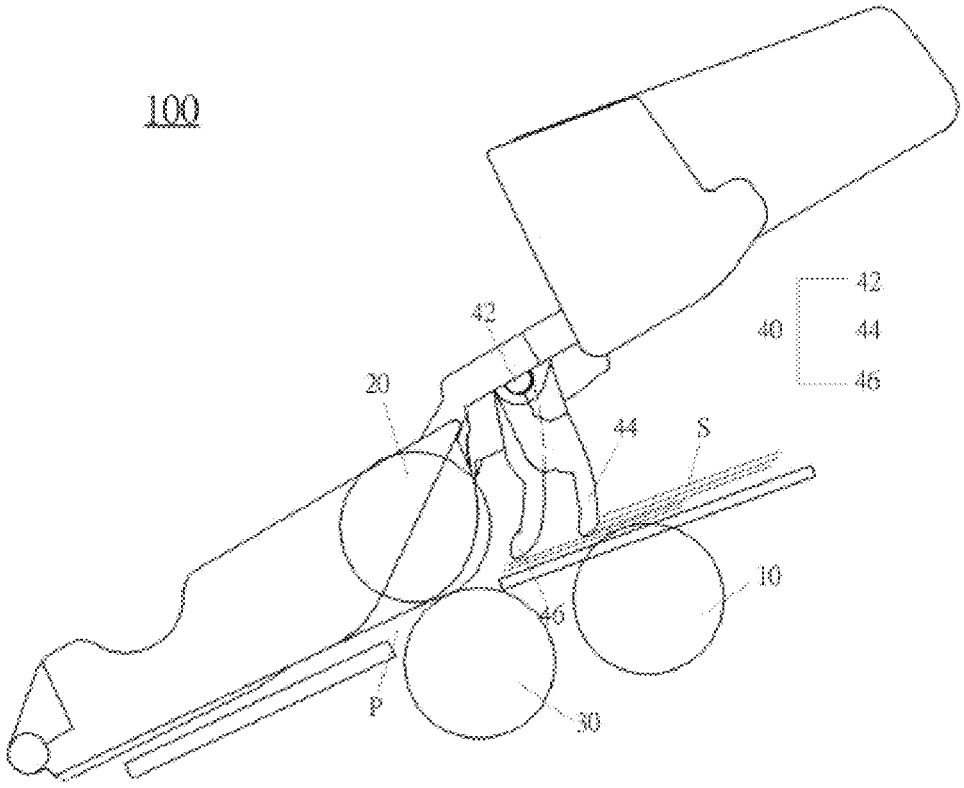
FIG. 2 is a schematic view illustrating the feeding device depicted in FIG. 1 with thin sheets.

When the sheets S are placed, the sheets S are contacted with the stopper 40, and can be constituted a structure of wedge-shaped inclined plane (shown as the dotted line of FIG. 1). FIG. 2 is a schematic view illustrating the feeding device depicted in FIG. 1 with thin sheets. In FIG. 2, the sheets S are thin sheets. The long arm 46 of the stopper 40 can be pushed by the sheets S located in lower layer, but the weight of the sheets S located in lower layer still are not enough to push the short arm 44. Thus, the short arm 44 also blocks the sheets S located in upper layer. In the period, the sheets S located in lower layer are transported to contact with the sheet-separating roller 20 and the friction institution 30 by the sheet-transporting roller 10. This ensures the sheets S located in lower layer be picked up firstly. When the sheets S located in lower layer are feed by the sheet-separating roller 20 individually, the sheets S located in upper layer will fall down due to gravity and be transported to push the long arm 46 by the sheet-transporting roller 10. In the present invention, the above design can keep the structure of wedge-shaped inclined plane to contact with the sheet-separating roller 20 and the friction institution 30.

Figure 3:
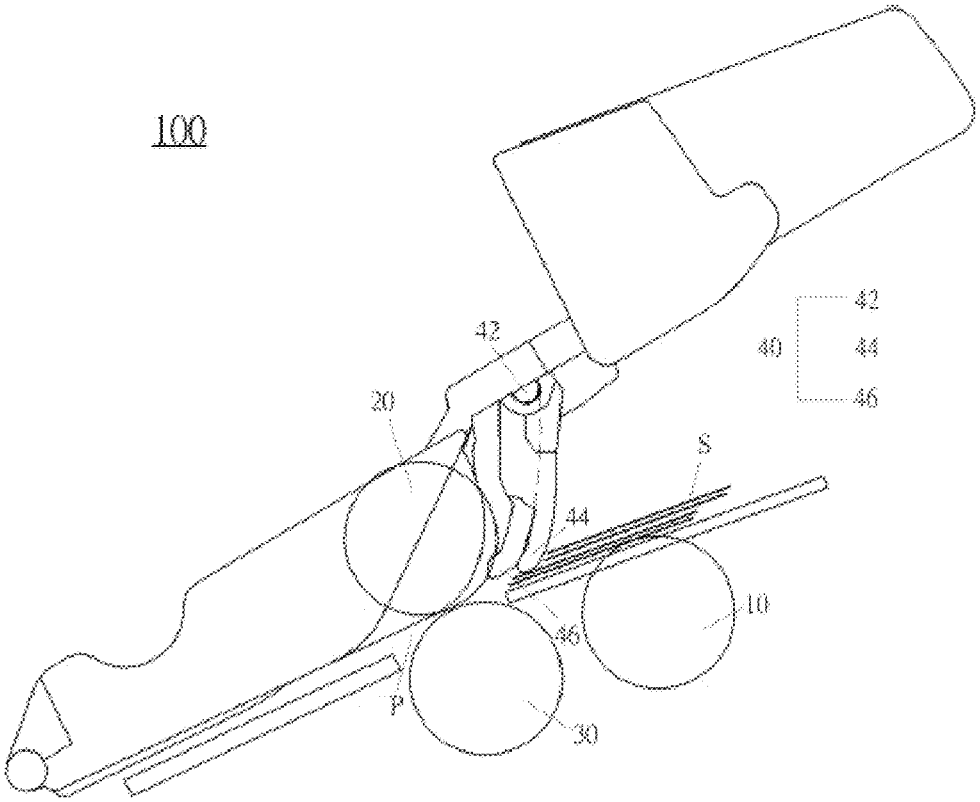
FIG. 3 is a schematic view illustrating the feeding device depicted in FIG. 1 with thick sheets.

FIG. 3 is a schematic view illustrating the feeding device depicted in FIG. 1 with thick sheets. In FIG. 3, the sheets S are contacted with the stopper 40, and the sheets S are thick sheets. Worth mention, the short arm 44 and the long arm 46 can be pushed by the weight of the thick sheet and keep the structure of wedge-shaped inclined plane to contact with the sheet-separating roller 20 and the friction institution 30. Thus, by the design of the sheet-transporting roller 10, the lowermost sheet located in the bottom of wedge-shaped inclined plane can be contacted with the sheet-separating roller 20 and the friction institution 30 firstly, and be feed in sequence of bottom-up individually. When the sheets S located in lower layer are feed completely, the sheets S located in upper layer are followed to contact with the sheet-separating roller 20 and the friction institution 30 by the assistance of the sheet-transporting roller 10. Thus, the feeding device 100 will keep picking up sheets S in sequence of bottom-up individually and complete the feeding process. This design not only makes the result of the scanning sequence properly, but also avoids the risk of multiple feeding and jamming.

Figure 4:
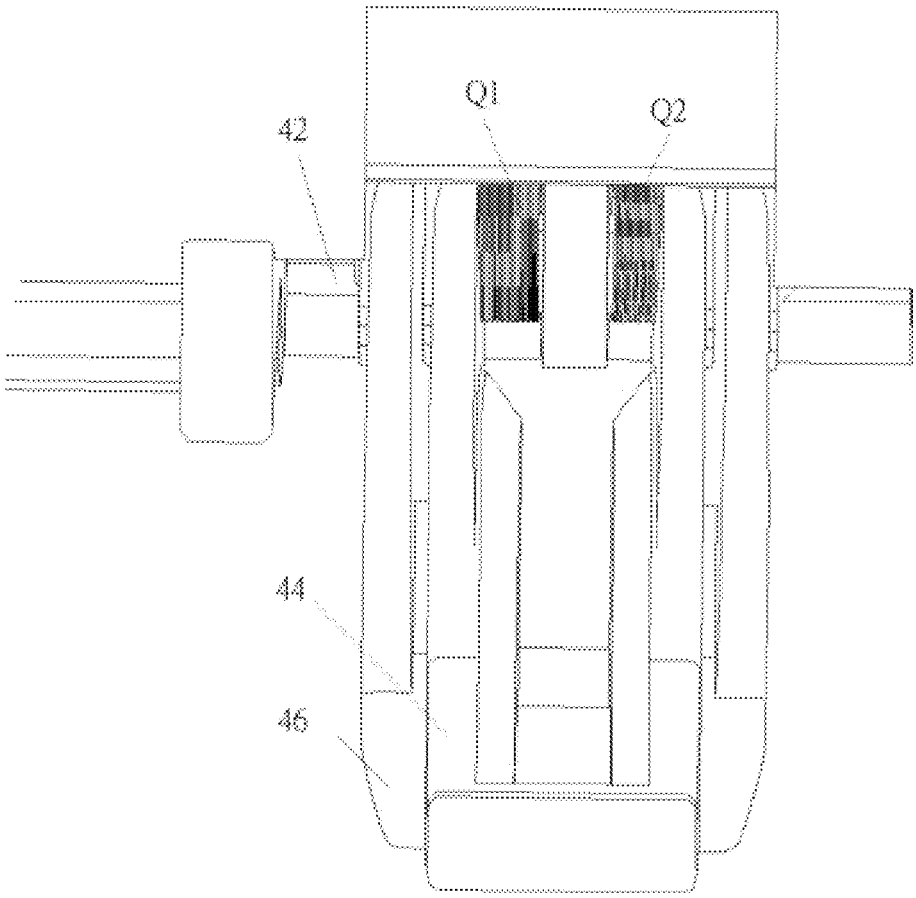
FIG. 4 is a schematic view illustrating the stopper according to one embodiment of the present invention.

FIG. 4 is a schematic view illustrating the stopper according to one embodiment of the present invention. Referring to FIG. 4, the short arm 44 and the long arm 46 are coaxially connected with axle 42 which being a fulcrum. The short arm 44 includes a heavy spring Q1 with a first elastic force, and the long arm 46 includes a light spring Q2 with a second elastic force, wherein the first elastic force is larger than the second elastic force. When the component force of the weight of the thin sheet placed in the paper passage P is larger than the second elastic force of the light spring Q2, the long arm 46 can be pushed by the thin sheet. When the component force of the weight of the thick sheet in the paper passage P is larger than the first elastic force of the heavy spring Q1, the short arm 44 is pushed by the thick sheet. In the present embodiment, the differences between the heavy spring Q1 and the light spring Q2 are, for example, the spring material, the winding turn number, and other factors, including but not limited. In addition, the disposing mode of the spring is not limited in the mode shown as FIG. 4. Besides, in the present invention, the essential element of multistage stopper not limited as a spring. The present invention also can reach the mode that a threshold of the force for pushing the short arm 44 is larger than a threshold of the force for pushing the long arm 46 by applying other devices or means.

Figure 5:
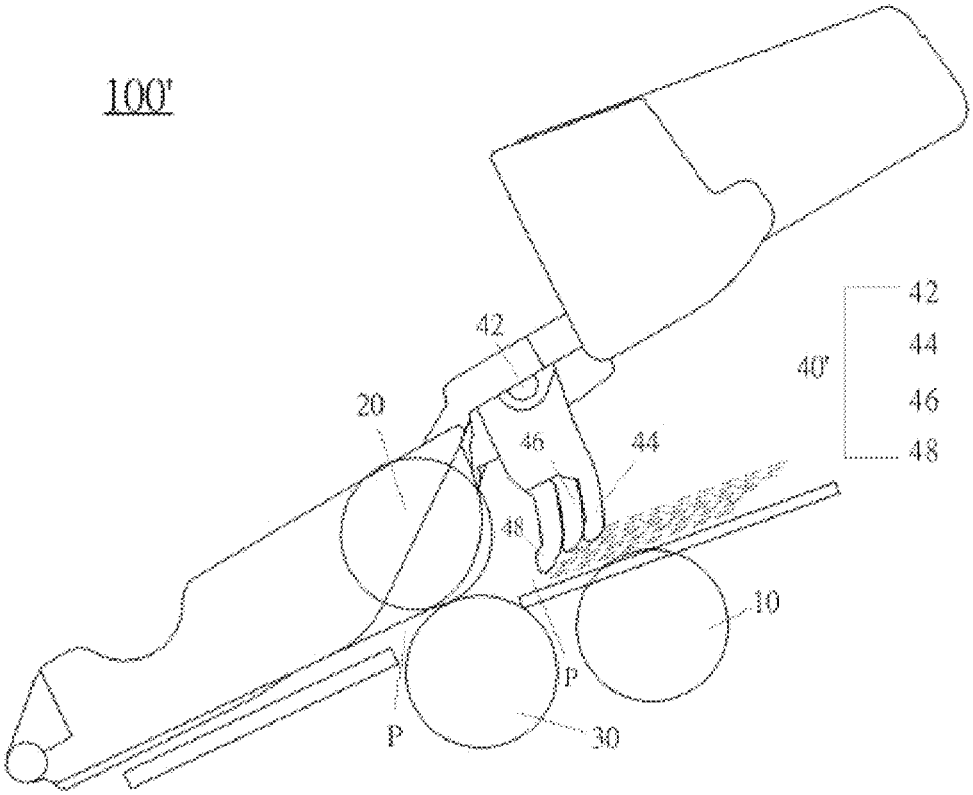
FIG. 5 is a schematic view illustrating the feeding device according to another embodiment of the present invention.
Figure 6:
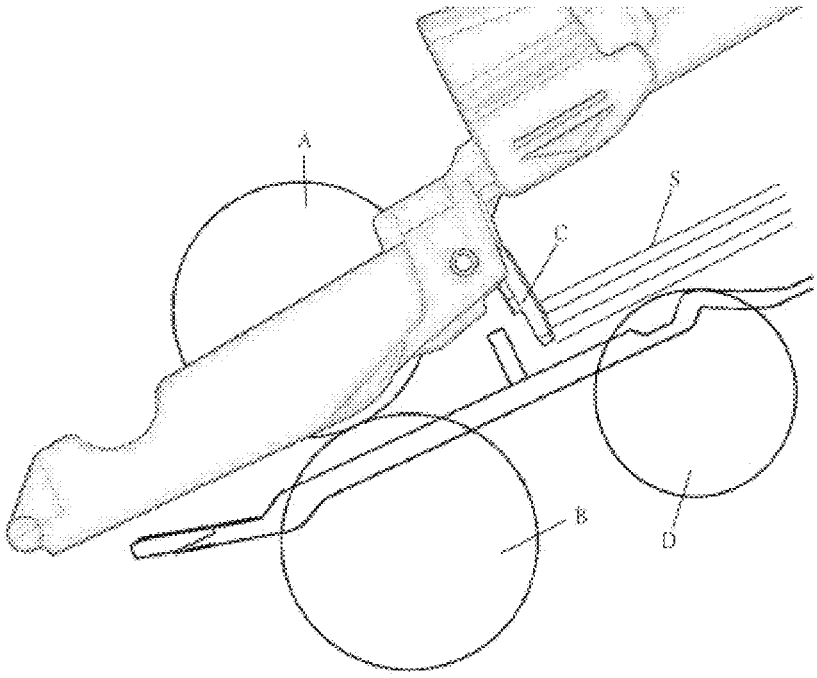
Fig. 6 (PRIOR ART)
FIG. 6 is a cross-sectional view of conventional feeding device.

FIG. 5 is a schematic view illustrating the feeding device according to another embodiment of the present invention. Further, the stopper 40' of the feeding device 100' also includes a third arm 48 which length is longer than the length of the long arm 46. The third arm 48 is connected to the axle 42 which being the fulcrum, wherein the third arm 48 is connected to the axle 42 with the short arm 44 and the long arm 46 coaxially. When the sheets S are not placed, the third arm 48 is close to the long arm 46, and the third arm 48 is located in back of the long arm 46. A threshold of the force for pushing third arm 48 is smaller than a threshold of the force for pushing the long arm 46. By the above design, the stopper 40' can guide the sheets S with gradation, and cause the stack of sheets S to constitute the structure of wedge-shaped inclined plane. Thus, the above design can fit to multiple types of sheets.

From above, in the feeding device with multistage stop arms of the present invention, the stack of sheets can be guided in sequence, and be constituted the structure of wedge-shaped inclined plane which is advantageous for the sheet-separating roller to pick up the sheets. The present invention also can fit to multiple types of sheets widely, such as thin sheets or thick sheets with different weight and thickness. Compared to the prior art, thin sheets can pass through the long arm of the stopper, but the sheets located in upper layer be blocked by the short arm to keep the structure of wedge-shaped inclined plane. This also avoids jamming in the disposition of stopper when the arm can't be push by the thin sheets. Especially, the design of multistage stop arms further cause the thick sheets to constituted the structure of wedge-shaped inclined plane more sequent, and ensure sheet-separating roller to pick up the sheet from the bottom of a stack of sheets. This also ensures the result of the scanning sequence properly and avoids the risk of multiple feeding and jamming.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A feeding device, comprising:

a paper passage;

a sheet-separating roller, disposed in the paper passage;

a friction institution, disposed in the paper passage and be opposite to the sheet-separating roller; and a stopper, disposed in the upstream side of the sheet-separating roller, the stopper includes a axle, a short arm connected to the axle which being a fulcrum, and a long arm disposed on the axle with the short arm coaxially;

wherein, a threshold of the force for pushing the short arm is larger than a threshold of the force for pushing the long arm;

wherein, the short arm includes a heavy spring with a first elastic force, and the long arm includes a light spring with a second elastic force, wherein the first elastic force is larger than the second elastic force.

2. The feeding device of claim 1, wherein the stopper causes sheets to constitute a structure of wedge-shaped inclined plane.

3. The feeding device of claim 1, wherein the long arm is close to the short arm.

4. The feeding device of claim 3, wherein the long arm is located in back of the short arm.

5. The feeding device of claim 1, further comprising a sheet-transporting roller, disposed in the paper passage and located in the upstream side of the sheet-separating roller.

6. The feeding device of claim 5, wherein at least one of sheets located in lower layer be transported to contact with the sheet-separating roller and the friction institution by the sheet-transporting roller.

7. The feeding device of claim 1, wherein the stopper further comprising a third arm which length be longer than the length of the long arm, and the third arm is connected to the axle with the short arm and the long arm coaxially.

8. The feeding device of claim 7, wherein the third arm is close to the long arm, and the third arm is located in back of the long arm.

9. The feeding device of claim 7, wherein a threshold of the force for pushing the third arm is smaller than a threshold of the force for pushing the long arm.

10. A feeding device, comprising:

a paper passage;

a roller assembly, disposed in the paper passage; and a stopper, disposed opposite the roller assembly, the stopper comprising multiple stop arms with a first elastic force and a second elastic force, wherein, the stopper further comprising a axle, a short arm connected to the axle which being a fulcrum, and a long arm close to the short arm and disposed on the axle with the short arm coaxially, wherein, the short arm includes a heavy spring with the first elastic force, and the long arm includes a light spring with the second elastic force, wherein, the first elastic force is larger than the second elastic force.

11. The feeding device of claim 10, wherein the stopper causes sheets to constitute a structure of wedge-shaped inclined plane.

12. The feeding device of claim 10, further comprising a friction institution, and the roller assembly includes a sheet-separating roller and a sheet-transporting roller located in the upstream side of the sheet-separating roller, the friction institution is disposed in the paper passage and be opposite to the sheet-separating roller, at least one of sheets located in lower layer be transported to contact with the sheet-separating roller and the friction institution by the sheet-transporting roller.

13. The feeding device of claim 12, wherein the stopper is disposed in the upstream side of the sheet-separating roller.

14. The feeding device of claim 10, wherein the long arm is located in back of the short arm, a threshold of the force for pushing the short arm is larger than a threshold of the force for pushing the long arm.

15. The feeding device of claim 14, wherein the stopper further comprising a third arm connected to the axle with the short arm and the long arm coaxially and located in back of the long arm, the length of the third arm is longer than the length of the long arm, and a threshold of the force for pushing the third arm is smaller than a threshold of the force for pushing the long arm.

16. A feeding device, being suitable for transporting sheets, the feeding device comprising:

a paper passage;

a roller assembly, transporting sheets in the paper passage; and a stopper, comprising multiple stop arms with a first elastic force and a second elastic force, wherein, the stopper further comprising a axle, a short arm connected to the axle which being a fulcrum, and a long arm close to the short arm and disposed on the axle with the short arm coaxially, wherein, the short arm includes a heavy spring with the first elastic force, and the long arm includes a light spring with the second elastic force, wherein, the first elastic force is larger than the second elastic force;

wherein, the velocity of sheets blocked by the first elastic force is slower than the velocity of partial sheets blocked by the second elastic force.

17. The feeding device of claim 16, wherein a threshold of the force for pushing the short arm is larger than a threshold of the force for pushing the long arm.

* * * * *